US007034761B2

(12) United States Patent
Chiang et al.

(10) Patent No.: US 7,034,761 B2
(45) Date of Patent: Apr. 25, 2006

(54) DIRECTIONAL ANTENNA

(75) Inventors: Bing Chiang, Melbourne, FL (US); William R. Palmer, Melbourne, FL (US); Griffin K. Gothard, Satellite Beach, FL (US); Christopher A. Snyder, Melbourne, FL (US)

(73) Assignee: IPR Licensing, Inc., Wilmington, DE (US)

( * ) Notice: Subject to any disclaimer, the term of this patent is extended or adjusted under 35 U.S.C. 154(b) by 0 days.

(21) Appl. No.: 10/889,662

(22) Filed: Jul. 12, 2004
(Under 37 CFR 1.47)

(65) Prior Publication Data

US 2005/0035910 A1 Feb. 17, 2005

Related U.S. Application Data

(63) Continuation of application No. 10/282,955, filed on Oct. 28, 2002, now Pat. No. 6,762,722, which is a continuation-in-part of application No. 09/861,296, filed on May 18, 2001, now Pat. No. 6,480,157.

(51) Int. Cl.
*H01Q 9/00* (2006.01)

(52) U.S. Cl. ..... 343/745; 343/700 MS

(58) Field of Classification Search ..... 343/833, 343/834, 795, 797, 700 MS, 745, 817, 818
See application file for complete search history.

(56) References Cited

U.S. PATENT DOCUMENTS 3,846,799 A 11/1974 Gueguen ..... 343/833
5,173,715 A 12/1992 Rodal et al. ..... 343/795
5,521,610 A 5/1996 Rodal ..... 373/797
5,617,102 A 4/1997 Prater ..... 342/374
5,771,025 A 6/1998 Reece et al. ..... 343/828
5,905,473 A 5/1999 Taenzer ..... 343/834
6,054,955 A 4/2000 Schlegel, Jr. et al. ..... 343/702
6,111,549 A 8/2000 Feller ..... 343/795
6,340,956 B1 1/2002 Bowen et al. ..... 343/915
6,476,773 B1 11/2002 Palmer et al. ..... 343/795
6,480,157 B1 11/2002 Palmer et al. ..... 343/700

OTHER PUBLICATIONS

Ohira et al., Electronically Steerable Passive Array Radiator Antennas for Low-Cost Analog Adaptive Beamforming, 0-7803-6345-0/00, 2000, IEEE.
Scott et al., Diversity Gain From a Single-Port Adaptive Antenna Using Switched Parasitic Elements Illustrated with a Wire and Monopole Prototype, IEEE Transactions on Antennas and Propagation, vol. 47, No. 6, Jun. 1999.
King, The Theory of Linear Antennas, pp. 622-637, Harvard Univesity Press, Cambridge, Mass., 1956.
Lo et al., Antenna Handbook: Theory, Applications and Design, pp. 21-38, Van Nostrand Reinhold Co., New York, 1988.

*Primary Examiner*—Hoang V. Nguyen
(74) *Attorney, Agent, or Firm*—Allen, Dyer, Doppelt, Milbrath & Gilchrist, P.A.

(57) ABSTRACT

An antenna includes a dielectric substrate, an ative antenna element carried by the dielectric substrate, and passive antenna elements carried by the dielectric substrate. The passive antenna elements are laterally adjacent the active antenna element. A respective impedance element is selectively connectable to each passive antenna element for antenna beam steering. Image elements are carried by the dielectric substrate, and a respective image element is connected to each impedance element and ground.

31 Claims, 12 Drawing Sheets

DIRECTIONAL ANTENNA

RELATED APPLICATION

This application is a continuation of 10/282,955 filed Oct. 28, 2002 now U.S. Pat. No. 6,762,722, which is a continuation-in-part of U.S. application Ser. No. 09/861,296, filed May 18, 2001 now U.S. Pat. No. 6,480,157. The entire teachings of the above applications are incorporated herein by reference.

FIELD OF THE INVENTION

This invention relates to mobile or portable cellular communication systems, and more particularly to a compact antenna apparatus for use with mobile or portable subscriber units.

BACKGROUND OF THE INVENTION

Code division multiple access (CDMA) communication systems provide wireless communications between a base station and one or more mobile or portable subscriber units. The base station is typically a computer-controlled set of transceivers that are interconnected to a land-based public switched telephone network (PSTN). The base station further includes an antenna apparatus for sending forward link radio frequency signals to the mobile subscriber units and for receiving reverse link radio frequency signals transmitted from each mobile unit. Each mobile subscriber unit also contains an antenna apparatus for the reception of the forward link signals and for the transmission of the reverse link signals. A typical mobile subscriber unit is a digital cellular telephone handset or a personal computer coupled to a cellular modem. In such systems, multiple mobile subscriber units may transmit and receive signals on the same center frequency, but unique modulation codes distinguish the signals sent to or received from individual subscriber units.

In addition to CDMA, other wireless access techniques employed for communications between a base station and one or more portable or mobile units include those described by the Institute of Electrical and Electronics Engineers (IEEE) 802.11 standard and the industry-developed Bluetooth standard. All such wireless communications techniques require the use of an antenna at both the receiving and transmitting end. It is well-known by experts in the field that increasing the antenna gain in any wireless communication system has beneficial affects on wireless systems performance.

A common antenna for transmitting and receiving signals at a mobile subscriber unit is a monopole antenna (or any other antenna with an omnidirectional radiation pattern) A monopole consists of a single wire or antenna element that is coupled to a transceiver within the subscriber unit. Analog or digital information for transmission from the subscriber unit is input to the transceiver where it is modulated onto a carrier signal at a frequency using a modulation code (i.e., in a CDMA system) assigned to that subscriber unit. The modulated carrier signal is transmitted from the subscriber unit to the base station. Forward link signals received by the subscriber unit are demodulated by the transceiver and supplied to processing circuitry within the subscriber unit.

The signal transmittal from a monopole antenna is omnidirectional in nature. That is, the signal is sent with approximately the same signal strength in all directions in a generally horizontal plane. Reception of a signal with a monopole antenna element is likewise omnidirectional. A monopole antenna does not differentiate in its ability to detect a signal in one azimuth direction versus detection of the same or a different signal coming from another azimuth direction. Also, a monopole antenna does not produce significant radiation in the elevation direction. The antenna pattern is commonly referred to as a donut shape with the antenna element located at the center of the donut hole.

A second type of antenna that may be used by mobile subscriber units is described in U.S. Pat. No. 5,617,102. The directional antenna comprises two antenna elements mounted on the outer case of a laptop computer, for example. A phase shifter attached to each element imparts a phase angle delay to the input signal, thereby modifying the antenna pattern (which applies to both the receive and transmit modes) to provide a concentrated signal or beam in the selected direction. Concentrating the beam increases the antenna gain and directivity. The dual element antenna of the cited patent thereby directs the transmitted signal into predetermined sectors or directions to accommodate for changes in orientation of the subscriber unit relative to the base station, thereby minimizing signal loss due to the orientation change. In accordance with the antenna reciprocity theorem, the antenna receive characteristics are similarly effected by the use of the phase shifters.

CDMA cellular systems are interference limited systems. That is, as more mobile or portable subscriber units become active in a cell and in adjacent cells, frequency interference increases and thus bit error rates also increase. To maintain signal and system integrity in the face of increasing error rates, the system operator decreases the maximum data rate allowable for one or more users, or decreases the number of active subscriber units, which thereby clears the airwaves of potential interference. For instance, to increase the maximum available data rate by a factor of two, the number of active mobile subscriber units is halved. However, this technique cannot generally be employed to increase data rates due to the lack of service priority assignments to the subscribers. Finally, it is also possible to avert excessive interference by using directive antennas at both (or either) the base station and the portable units, Typically, a directive antenna beam pattern is achieved through the use of a phased array antenna. The phased array antenna is electronically scanned or steered to the desired direction by controlling the phase angle of the input signal to each antenna element. However, phase array antennas suffer decreased efficiency and gain as the element spacing becomes electrically small when compared to the wavelength of the received or transmitted signal. When such an antenna is used in conjunction with a portable or mobile subscriber unit, generally the antenna array spacing is relatively small and thus antenna performance is correspondingly compromised.

In a communication system in which portable or mobile units communicate with a base station, such as a CDMA communication system, the portable or mobile unit is typically a hand-held device or a relatively small device, such as, for instance, the size of a laptop computer. In some embodiments, the antenna is inside or protrudes from the devices housing or enclosure. For example, cellular telephone hand sets utilize either an internal patch antenna or a protruding monopole or dipole antenna. A larger portable device, such as a laptop computer, may have the antenna or antenna array mounted in a separate enclosure or integrated into the laptop housing. A separately-enclosed antenna may be cumbersome for the user or manage as the communications device is carried from one location to another. While integrated antennas overcome this disadvantage, such antennas, except for a patch antenna, generally are in the form of protrusions from the communications device. These protrusions can be broken or damaged, as the device is moved from one location to another. Even minor damage to a protruding antenna can drastically alter its operating characteristics.

SUMMARY OF THE INVENTION

Problems of the Prior Art

Several considerations must be taken into account in integrating a wireless-network antenna into an enclosure, whether the enclosure comprises a unit separate from the communications device or the housing of the communications device itself. In designing the antenna and its associated enclosure, careful consideration must be given to the antenna electrical characteristics so that signals propagating over the wireless link satisfy pre-determined system standards, such as, the bit error rate, signal-to-noise ratio or signal-to-noise-plus-interference ratio. The electrical properties of the antenna, as influenced by the antenna physical parameters, are discussed further herein below.

The antenna must also exhibit certain mechanical characteristics to satisfy user needs and meet the required electrical performance. The antenna length, or the length of each element of the antenna array, depends on the received and transmitted signal frequencies. If the antenna is configured as a monopole, the length is typically a quarter wavelength of the signal frequency. For operation at 800 MHz (one of the wireless frequency bands), a quarter-wavelength monopole is 3.7 inches long. The length of a half-wavelength dipole is 7.4 inches.

The antenna must further present an aesthetically pleasing appearance to the user. If the antenna is deployable from the communications device, sufficient volume within the communications device must be allocated to the stored antenna and peripheral components. But since the communications device is used in mobile or portable service, the device must remain relative small and light with a shape that allows it to be easily carried. The antenna deployment mechanism must be mechanically simple and reliable. For those antennas housed in the enclosure separate from the communications device, the connection mechanism between the antenna and the communications device must be reliable and simple.

Not only are the electrical, mechanical and aesthetic properties of the antenna important, but it must also overcome unique performance problems in the wireless environment. One such problem is called multipath fading. In multipath fading, a radio frequency signal transmitted from a sender (either a base station or mobile subscriber unit) may encounter interference in route to the intended receiver. The signal may, for example, be reflected from objects, such as buildings, thereby directing a reflected version of the original signal to the receiver. In such instances, two versions of the same radio frequency signal are received; the original version and a reflected version. Each received signal is at the same frequency, but the reflected signal may be out of phase with the original due to the reflection and consequence differential transmission path length to the receiver. As a result, the original and reflected signals may partially cancel each other out (destructive interference), resulting in fading or dropouts in the received signal.

Single element antennas are highly susceptible to multipath fading. A single element antenna cannot determine the direction from which a transmitted signal is sent and therefore cannot be tune to more accurately detect and received a transmitted signal. Its directional pattern is fixed by the physical structure of the antenna components. Only the antenna position and orientation can be changed in an effort to obviate the multipath fading effects.

The dual element antenna described in the aforementioned patent reference is also susceptible to multipath fading due to the symmetrical and opposing nature of the hemispherical lobes of the antenna pattern. Since the antenna pattern lobes are more or less symmetrical and opposite from one another, a signal reflected to the back side of the antenna may have the same received power as a signal received at the front. That is, if the transmitted signal reflects from an object beyond or behind the intended received and then reflects into the back side of the antenna, it will interfere with the signal received directly from the source, at points in space where the phase difference in the two signals creates destructive interference due to multipath fading.

Another problem present in cellular communication systems is inter-cell signal interference. Most cellular systems are divided into individual cells, with each cell having a base station located at its center. The placement of each base station is arranged such that neighboring base stations are located at approximately sixty degree intervals from each other. Each cell may be viewed as a six sided polygon with a base station at the center. The edges of each cell abut the neighboring cells and a group of cells form a honeycomb-like pattern. The distance from the edge of a cell to its base station is typically driven by the minimum power required to transmit an acceptable signal from a mobile subscriber unit located near the edge of the cell to that cell's base station (i.e., the power required to transmit an acceptable signal a distance equal to the radius of one cell).

Intercell interference occurs when a mobile subscriber unit near the edge of one cell transmits a signal that crosses over the edge into a neighboring cell and interferes with communications taking place within the neighboring cell. Typically, signals in neighboring cells on the same or closely spaced frequencies cause intercell interference. The problem of intercell interference is compounded by the fact that subscriber units near the edges of a cell typically transmit at higher power levels so that the transmitted signals can be effectively received by the intended base station located at the cell center. Also, the signal from another mobile subscriber unit located beyond or behind the intended received may arrive at the base station at the same power level, representing additional interference.

The intercell interference problem is exacerbated in CDMA systems since the subscriber units in adjacent cells typically transmit on the same carrier or center frequency. For example, two subscriber units in adjacent cells operating at the same carrier frequency but transmitting to different base stations interfere with each other if both signals are received at one of the base stations. One signal appears as noise relative to the other. The degree of interference and the receiver's ability to detect and demodulate the intended signal is also influenced by the power level at which the subscriber units are operating. If one of the subscriber units is situated at the edge of a cell, it transmits at a higher power level, relative to other units within its cell and the adjacent cell, to reach the intended base station. But, its signal is also received by the unintended base station, i.e., the base station in the adjacent cell. Depending on the relative power level of two same-carrier frequency signals received at the unintended base station, it may not be able to properly differentiate a signal transmitted from within its cell from the signal transmitted from the adjacent cell. A mechanism is required to reduce the subscriber units antenna's apparent field of view, which can have a marked effect on the operation of the reverse link (subscriber to base) by reducing the number of interfering transmissions received at a base station. A similar improvement in the antenna pattern for the forward link, allows a reduction in the transmitted signal power to achieve a desired receive signal quality.

In summary, it is clear that in the wireless communications technology, it is of utmost importance to maximize antenna performance, while minimizing size and manufacturing complexity.

BRIEF DESCRIPTION OF THE PRESENT INVENTION

The present invention is a directional antenna having a number, N, of outlying monopole antenna elements. These monopole elements are formed as a first upper conductive segment on a portion of a dielectric substrate. The array also includes the same number, N, of image elements. The image elements are formed as a second set of lower conductive segments on the same substrate as the upper conductive segments. The image elements, generally having the same length and shape as the monopole elements, are connected to a ground reference potential. To complete the array, an active antenna element is also disposed on the same substrate, adjacent to at least one of the monopole elements. In a preferred embodiment, the active element is disposed in the center of the array.

The monopole elements are typically formed as elongated conductive sections on the dielectric substrate. The dielectric substrate itself may be formed as a first elongated section on which the conductive elements are disposed, and a second elongated section perpendicular to the first elongated section, forming an interconnecting arm between the first elongated section and the center active element. Likewise, the center active element may be formed as an elongated dielectric portion of the same substrate on which a conductive portion is disposed.

The image elements may be connected together electrically. In one embodiment, they are formed as a single conductive patch on the substrate.

In a preferred embodiment, the monopole antenna elements are electrically connected to act as passive elements; that is, only the single active center element is connected to radio transceiver equipment.

The passive monopole elements and corresponding image elements are selectively operable to in either a reflective or directive mode. In one configuration, each respective monopole element is connected to a corresponding one of the image elements through a coupling circuit. The coupling circuit may be as simple as a switch, providing a connected and un-connected selectable configuration.

However, in the preferred embodiment, the coupling circuit contains at least two impedances. In this configuration, a first impedance element is placed in series between the monopole element and the image element when the switch is in a first position, and a second impedance element is placed in series when the switch is in a second position.

The switches and impedances may typically be embodied as microelectronic components disposed on the same substrate as the antenna array elements. Signals supplied to the antenna array assembly may then control the switches for shorting or opening the connections between the upper portion and lower portion of each antenna element, to achieve either the directive or reflective operational state.

BRIEF DESCRIPTION OF THE DRAWINGS

The foregoing and other features and advantages of the invention will be apparent from the following more particular description of the preferred embodiments of the invention, as illustrated in the accompanying drawings in which like referenced characters refer to the same parts throughout the different figures. The drawings are not necessarily to scale, emphasis instead being placed upon illustrating the principles of the invention.

DETAILED DESCRIPTION OF THE PREFERRED EMBODIMENTS

Figure 1:
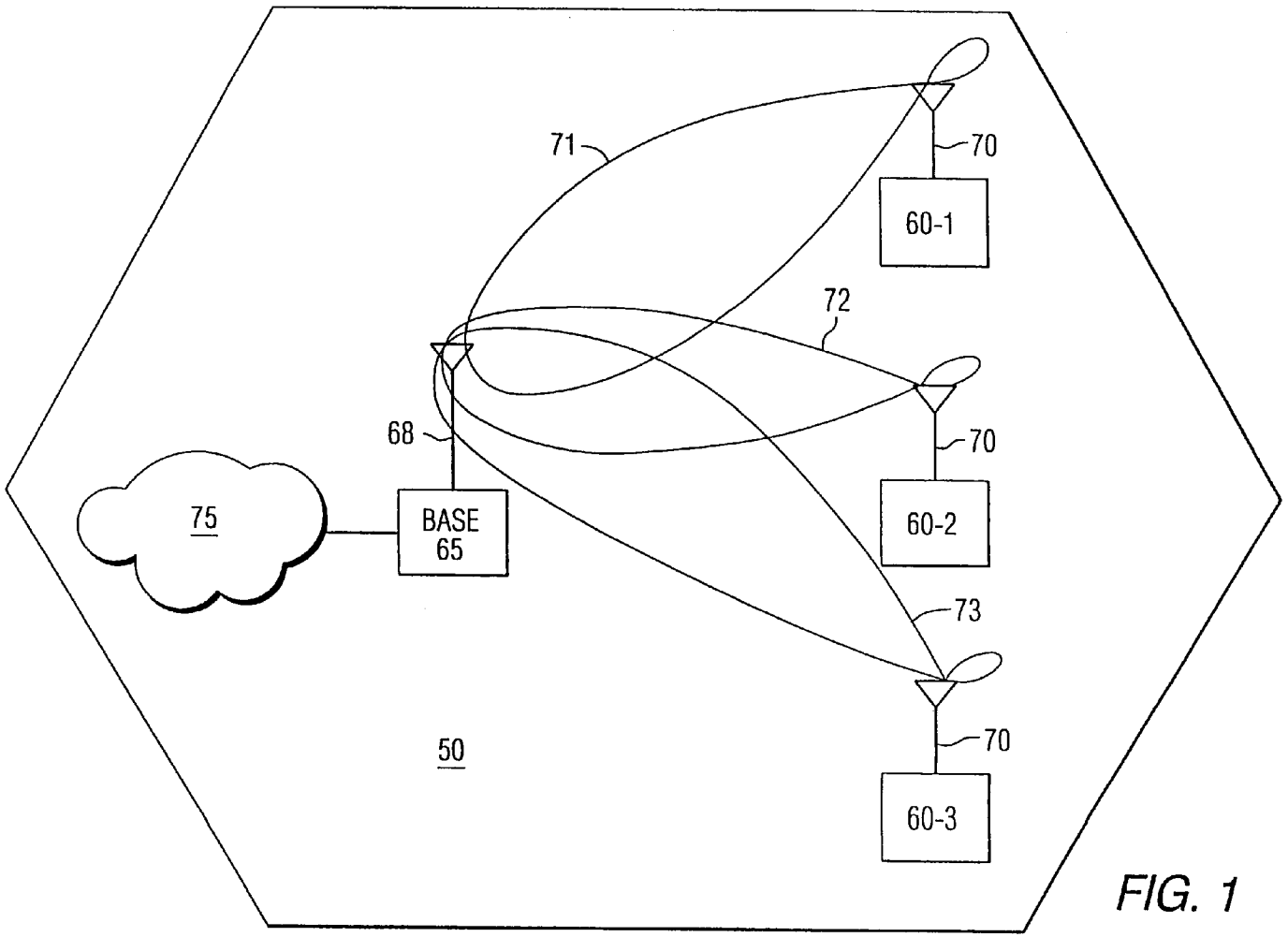
FIG. 1 illustrates a cell of a cellular-based wireless communications system.

FIG. 1 illustrates one cell 50 of a typical CDMA cellular communication system. The cell 50 represents a geographical area in which mobile subscriber units 60-1 through 60-3 communicate with a centrally located base station 65. Each subscriber unit 60 is equipped with an antenna 70 configured according to the present invention. The subscriber units 60 are provided with wireless data and/or voice services by the system operator and can connect devices such as, for example, laptop computers, portable computers, personal digital assistants (PDAs) or the like through base station 65 (including the antenna 68) to a network 75, which can be the public switched telephone network (PSTN), a packet switched computer network, such as the Internet, a public data network or a private network. The base station 65 communicates with the network 75 over any number of different available communications protocols such as primary rate ISDN, or other LAPD based protocols such as IS-634 or V5.2, or even TCP/IP if the network 75 is a packet based Ethernet network such as the Internet. The subscriber units 60 may be mobile in nature and may travel from one location to another while communicating with the base station 65. As the subscriber units leave one cell and enter another, the communications link is handed off from the base station of the exiting cell to the base station of the entering cell.

FIG. 1 illustrates one base station 65 and three mobile units 60 in a cell 50 by way of example only and for ease of description of the invention. The invention is applicable to systems in which there are typically many more subscriber units communicating with one or more base stations in an individual cell, such as the cell 50. The invention is further applicable to any wireless communication device or system, such as a wireless local area network.

It is also to be understood by those skilled in the art that FIG. 1 represents a standard cellular type communications systems employed signaling schemes such as a CDMA, TDMA, GSM or others, in which the radio frequency channels are assigned to carry date and/or voice between the base stations 65 and subscriber units 60. In a preferred embodiment, FIG. 1 is a CDMA-like system, using code division multiplexing principles such as those defined in the IS-95B standards for the air interface.

In one embodiment of the cell-base system, the mobile subscriber units 60 employ and antenna 70 that provides directional reception of forward link radio signals transmitted from the base station 65, as well as directional transmittal of reverse link signals (via a process called beam forming) from the mobile subscriber units 60 to the base station 65. This concept is illustrated in FIG. 1 by the example beam patterns 71 through 73 that extend outwardly from each mobile subscriber unit 60 more or less in a direction for best propagation toward the base station 65. By directing transmission more or less toward the base station 65, and directively receiving signals originating more or less from the location of the base station 65, the antenna apparatus 100 reduces the effects of intercell interference and multipath fading for the mobile subscriber units 60. Moreover, since the antenna beam patterns 71, 72, and 73 extend outward in the direction of the base station 65 but are attenuated in most other directions, less power is required for transmission of effective communications signals from the mobile subscriber units 60-1, 60-2 and 60-3 to the base station 65.

Figure 2:
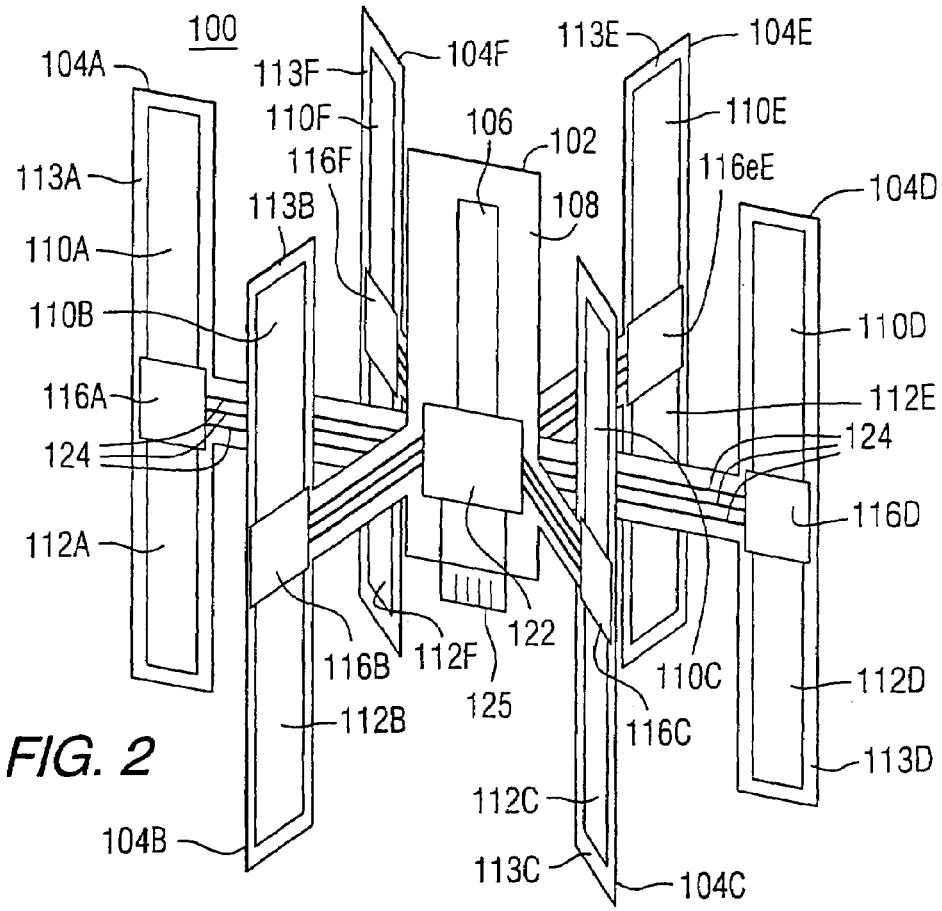
FIGS. 2 through 5 illustrate various views of an antenna.

FIG. 2 illustrates an antenna array 100 constructed according to the teachings of the present invention. The antenna array 100 includes a center element 102 surrounded by six passive elements 104A through 104F, each of which can be operated in a reflective or a directive mode as will be discussed further herein below. The antenna array 100 is not restricted to six passive elements. Other embodiments include fewer (e.g., two or four) or more (e.g., eight) passive elements. In yet another embodiment where the antenna operates as a phase array, to be discussed further below, the center element is absent.

The center element 102 comprises a conductive radiator 106 disposed on a dielectric substrate 108. Each passive element 104A through 104F comprises an upper conductive segment 110A through 110F and a lower conductive segment 112A through 112F disposed on a dielectric substrate 113A through 113F, respectively. The lower conductive segments 112A through F are grounded. Generally, the upper (110A–110F) and the lower (112A–112F) conductive segments are of equal length. When the upper conductive segment of one of the passive elements (for example, the upper conductive segment 110A) is connected to the respective lower conductive segment (the lower conductive segment 112A) the passive element 104A operates in a reflective mode such that all received radio frequency (RF) energy is reflected back from the passive element 104A toward the source. When the upper conductive segment 110A, for example, is open (i.e., not connected to the lower conductive segment 112A) the passive element 104A operates in a directive mode in which the passive element 104A essentially is invisible to the propagating RF energy which passes therethrough.

In one embodiment, the center element 102 and the passive elements 104A and 104D are fabricated from a single dielectric substrate, such as a printed circuit board, with the respective antenna elements disposed thereon. The passive elements, 104B and 104C are disposed on a deformable or flexural substrate and attached or mounted to one surface of the center element 102. Thus the passive elements 104B and 104C are foldable into a compact arrangement when not in use, and deformable into the radial positions illustrated in FIG. 2 for optimum operation. This is accomplished by folding (or deforming) the passive elements 104B and 104C about the attachment point toward the passive element 104A and 104D, respectively. Similarly, the passive elements 104E and 104F are disposed on a deformable or flexural substrate and attached or mounted to an opposing surface of the center element 102 so that the passive elements 104E and 104F are foldable into a compact arrangement when not in use or deployable into the configuration illustrated in FIG. 2 during operation. In another embodiment, each of the passive elements 104A through 104F are formed on a separate flexible dielectric substrate and deformably jointed to the center element 102. In still another embodiment, the passive elements 104A through 104F are formed on individual rigid dielectric substrates and deformably joined to the center element 102 by use of a deformable material interposed therebetween.

There are many devices and techniques available for attaching the deformable substrates carrying the passive elements 104A through 104F to the center element 102. An adhesive can be used to joint the surface of the center element 102 to the deformable substrates or the deformable material. Solderable vias can also be disposed into each of the surfaces to be mated. The joints are mated and the vias soldered so that the joints remain deformable. If it is required for signals to pass between the center element 102 and each of the passive elements 104A through 104F, then in another embodiment the solderable vias are connected to the appropriate conductive traces disposed on the center element 102 and the passive elements 104A through 104F. In this way, the soldered mated vias establish an electrical interconnection and a mechanical union between the passive elements 104A through 104F and the center element 102. Also, a mechanical fastener can also be utilized to joint the various passive elements 104A through 104F to the center element 102.

In yet another embodiment the center element 102 and the passive elements 104A and 104D are fabricated on a first deformable substrate, the passive elements 104B and 104C are fabricated on a second deformable substrate and the passive elements 104E and 104F are fabricated on a third deformable substrate. The three deformable substrates carrying the antenna elements are jointed as discussed above. In yet another embodiment, the center element 102 is formed of a rigid dielectric material, for example, printed circuit board, while the passive element 104A is disposed on a first deformable substrate, the passive elements 104B and 104C are formed on a second deformable substrate, the passive element 104D is formed on a third deformable substrate and the passive element 104E and 104F are disposed on a fourth deformable substrate. The four deformable substrates are then joined to the center element by way of soldered vias or an adhesive as discussed above.

In still another embodiment of the present invention, each of the passive elements 104A through 104F is disposed on a rigid dielectric substrate material and joined to the center element 102 by way of a deformable union. In particular, one edge of deformable or flexural material is attached to each of the passive elements 104A through 104F and the opposing edge of the material is attached to the center element 102. Thus in this embodiment, each antenna element is disposed on a rigid deformable material. Solderable vias or an adhesive are used to affix the deformable material to the center element 102.

Figure 5:
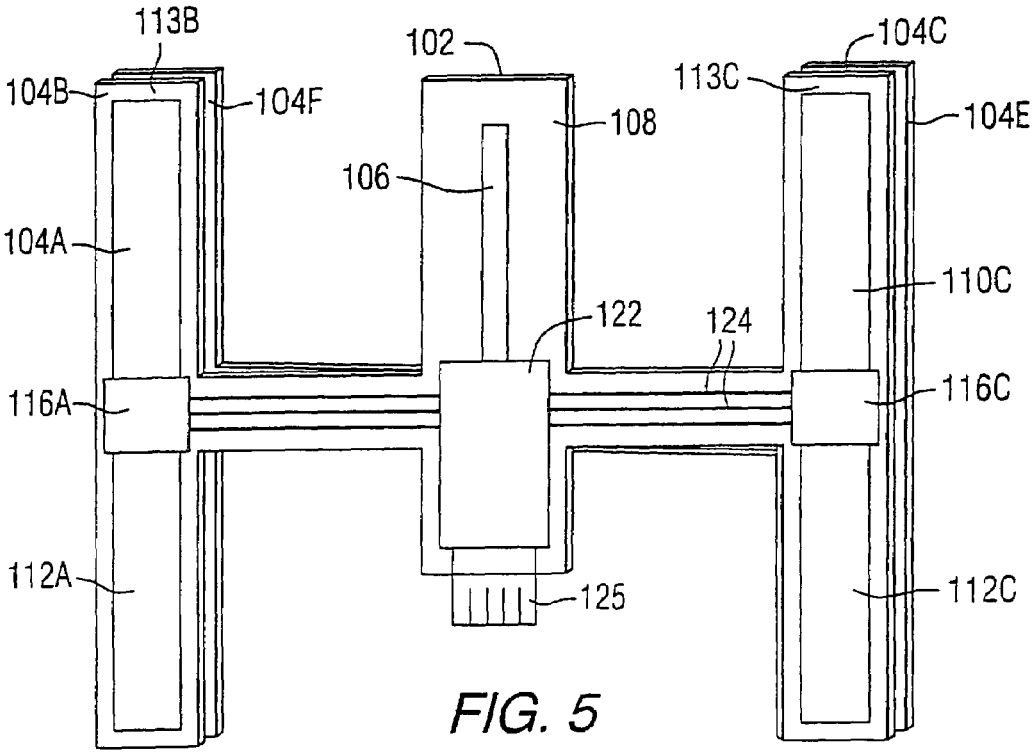
Figure 3:
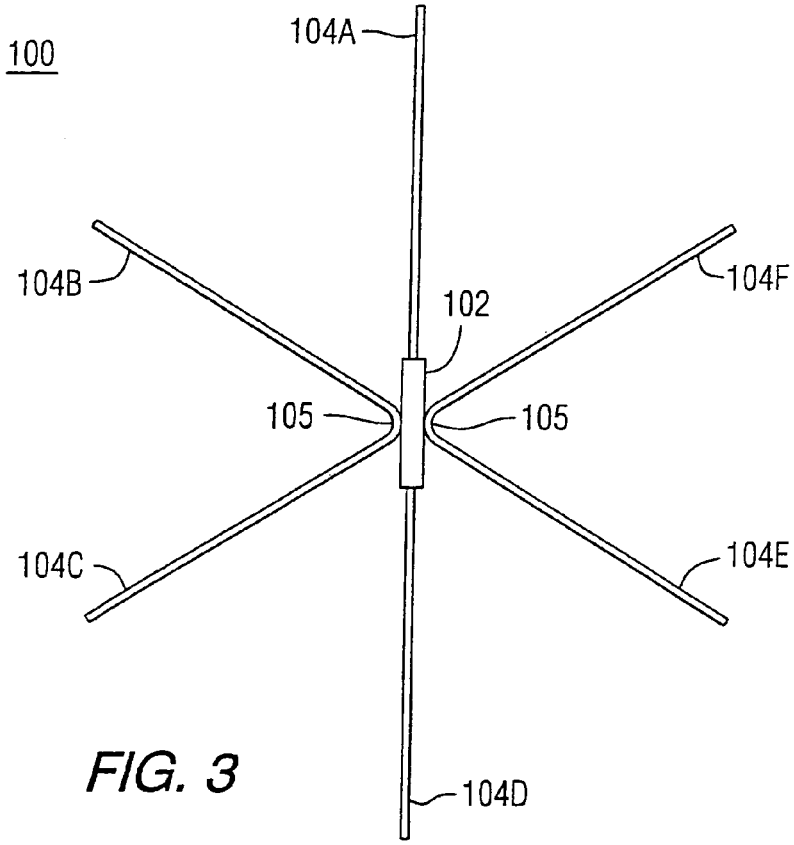
Figure 4:
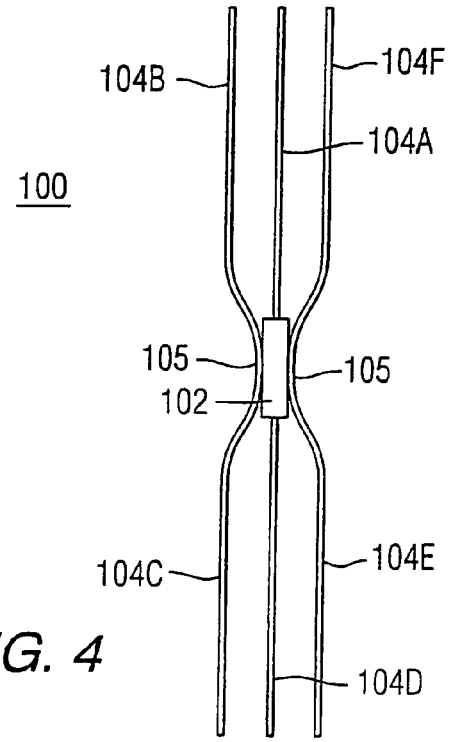

A top view of the antenna array 100 is illustrated in FIG. 3. In particular, the formable joints 105 are shown. FIG. 4 is a top view of the antenna array 100 in a folded configuration. The distance between adjacent passive elements (for example, between the passive elements 104A and 104B) is exaggerated in FIG. 4 for clarity. The deformable joints allow the adjacent elements to come into contact so that the antenna array 100 is storable in a very compact configuration. FIG. 5 is a perspective view of the antenna 100 is a folded configuration. Although the performance will be degraded, it is possible for the antenna array 100 to operate in the folded configuration of FIGS. 4 and 5.

Returning to FIG. 2, there is shown a microelectronics module 116A through 116F interposed between the upper conductive segments 110A through 110F and the lower conductive segments 112A through 112F of each passive element 104A through 104F. There is further shown a microelectronics module 122 disposed on the dielectric substrate 108, comprising, for example, transceiver circuitry. Conductive traces 124 conduct signals between the microelectronics module 112 and of the microelectronics modules 116A through 116F. The signals carried on the conductive traces 124 control components within the microelectronics modules 116A through 116F for operating the passive elements 104A through 104F in either the reflective or the directive state. Further connected to the microelectronics module 122 is an interface 125 for providing electrical connectivity between the antenna array 100 and the external communications device. The interface 125 can be constructed from either rigid or flexible material for interfacing (via a ribbon cable, for example) to a connector mounted on an enclosure enclosing the antenna array 100. In use, a conductor is inserted into the connector for connecting the antenna array 100 to the external device. It will be appreciated by those skilled in the art that various placements and conductor routing paths are available for the microelectronics modules and the conductive traces, as required for a specific antenna design and configuration.

Figure 6:
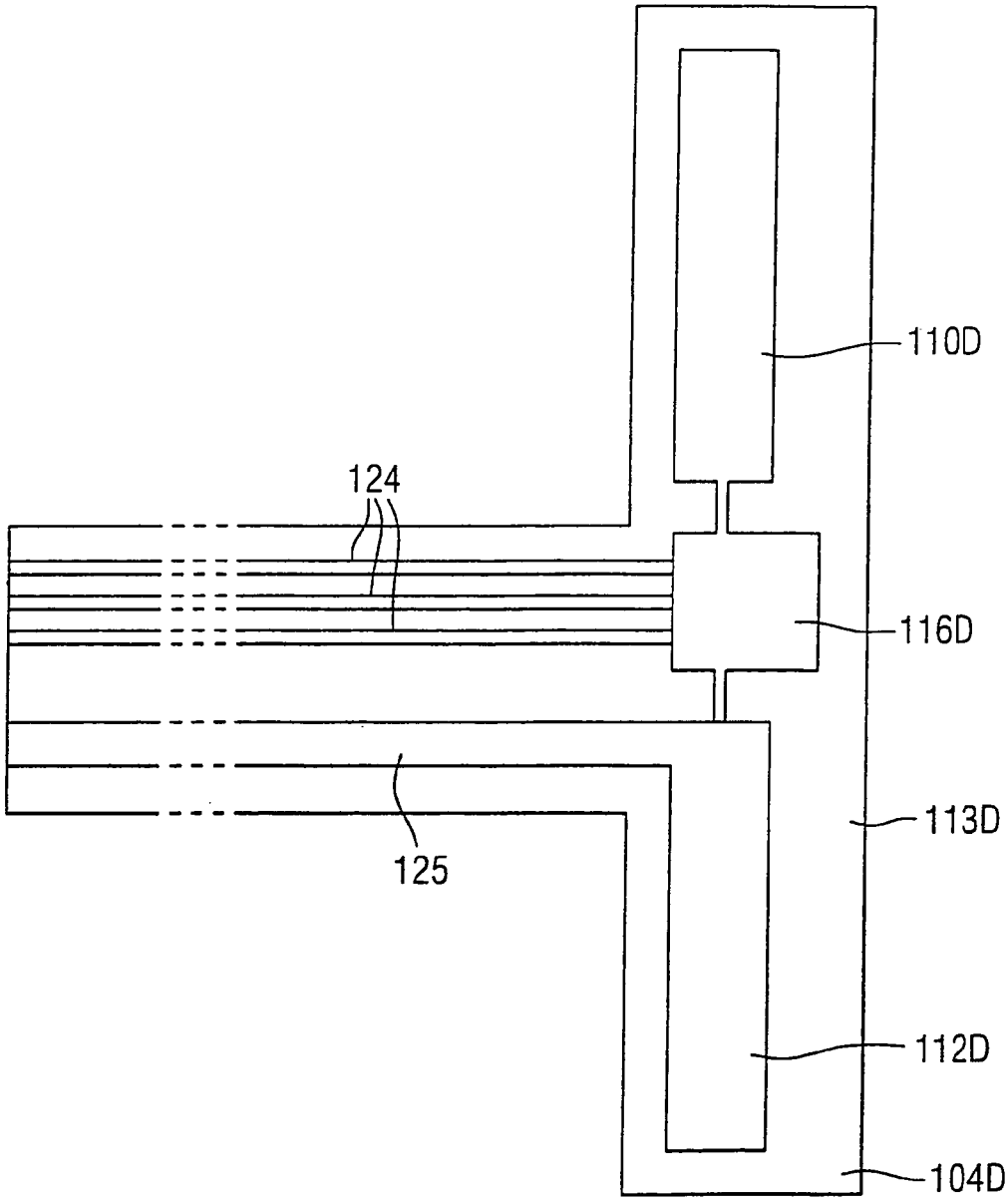
FIG. 6 is a more detailed view of a radial element shown in FIG. 2.

FIG. 6 is an enlarged view of one of the passive elements 104D, for example including the microelectronics module 116D and the conductive traces 124. The other passive elements are similarly constructed. The dielectric substrate 113D comprises a deformable (flexural) material or a rigid material having a first portion on which the upper conductive segment 110D and the lower conductive segment 112D are formed, and a second arm portion perpendicular to the first portion. In the embodiment where the passive element 104D is constructed of rigid material, the second arm portion includes a deformable material (not shown in FIG. 6) affixed to the end of the second arm portion. In one embodiment, the first portion carrying the upper and lower conductive segments and the second arm portion are formed by shaping or cutting a single sheet of the dielectric substrate material. The rigid embodiment can be formed from printed circuit board material including FR4 material, and the deformable embodiment can be formed from Kapton, polyimide, mylar, or any other deformable material. The selection of a suitable material is based on the desired mechanical and electrical properties of the antenna elements, including loss, permittivity and permeability. Three exemplary conductive traces 124 traversing the arm portion of the dielectric substrate 113D and connected to contacts (not shown) of the microelectronics module 116D are shown. Depending upon the characteristics of the switch employed within the microelectronics module 116D (to be discussed in conjunction with FIG. 7) fewer than three conductive trace 125 may be required for controlling that switch. Finally, as shown, a conductive trace 125 connects the lower conductive segment 112D to a grounded terminal, for example on the interface 125 shown in FIG. 2. The microelectronics module 116A is not confined to a switching function, but can include other functions related to operation of the antenna array 100 and its constituent elements. As is known to those skilled in the art, conductive material for forming the upper conductive segment 110D, the lower conductive segment 112D and the conductive traces 124 can be applied to the dielectric substrate by printing conductive epoxies or conductive inks thereon. Also, the conductive elements are formable by etching away the unwanted portions from a copper clad dielectric substrate.

Figure 7:
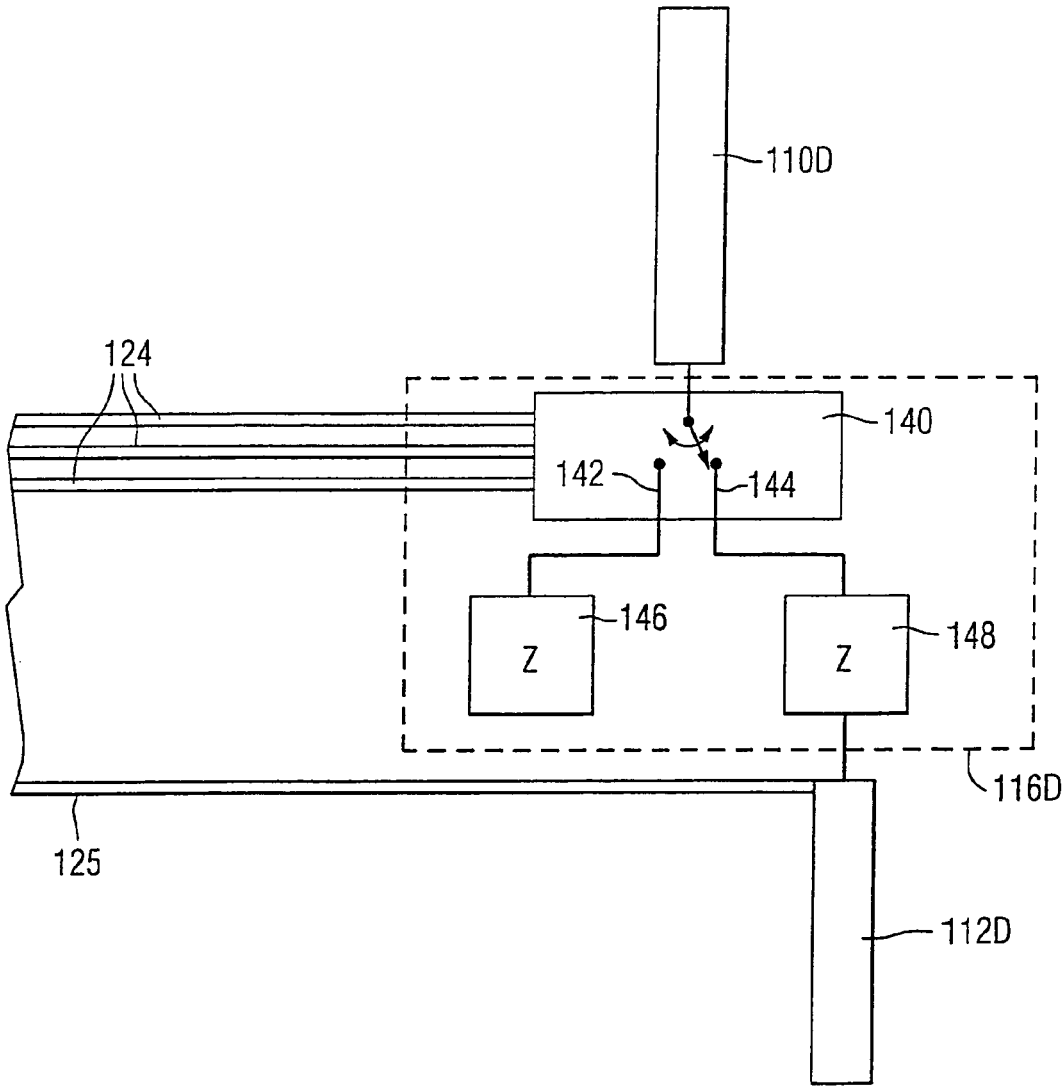
FIG. 7 is a pictorial representation of the microelectronics module of FIG. 6.

FIG. 7 illustrates an exemplary microelectronics module 116D, including a mechanical SPDT switch 140. Those skilled in the art recognize that the mechanical switch 140 is a simplistic representation of a switching device typically implemented with a junction diode, a MOSFET, a bipolar junction transistor, or a mechanical switch, including one fabricated using MEMS technology (microelectromechanical system). Under control of a signal carried on one of the conductive traces 124, the switch 140 is switched between contact with a conductor 142 and a conductor 144. When switched to the conductor 142, the upper conductive segment 100D is connected to an impedance element 146. The impedance element 146 compensates for reactances (i.e., capacitive or inductive) within the switch 140 so that the upper conductive segment 110D sees an open circuit when the switch 140 closes into the conductor 142. Alternatively, when the switch 140 connects to the conductor 144, the upper conductive segment 110D sees a grounded lower conductive segment 112D via an impedance element 148. The impedance element 148 cancels any reactances (i.e., capacitive or inductive) created in the switch 140 so that the upper conductive segment 110D sees a short to ground. In one embodiment, there are shown three conductive traces 124, for carrying a positive and negative bias voltage for biasing the electronic component implementing the SPDT switch 140, and further a control voltage signal for selecting the switch position. Depending upon the specific electronic or mechanical component implementing the switch 140, only a positive or a negative bias voltage may be required or the component may be switched without a bias voltage ad determined solely by a control voltage. Thus, other embodiments of the present invention may require numbers of conductive traces 124 connected to the microelectronics module 116D.

Figure 8:
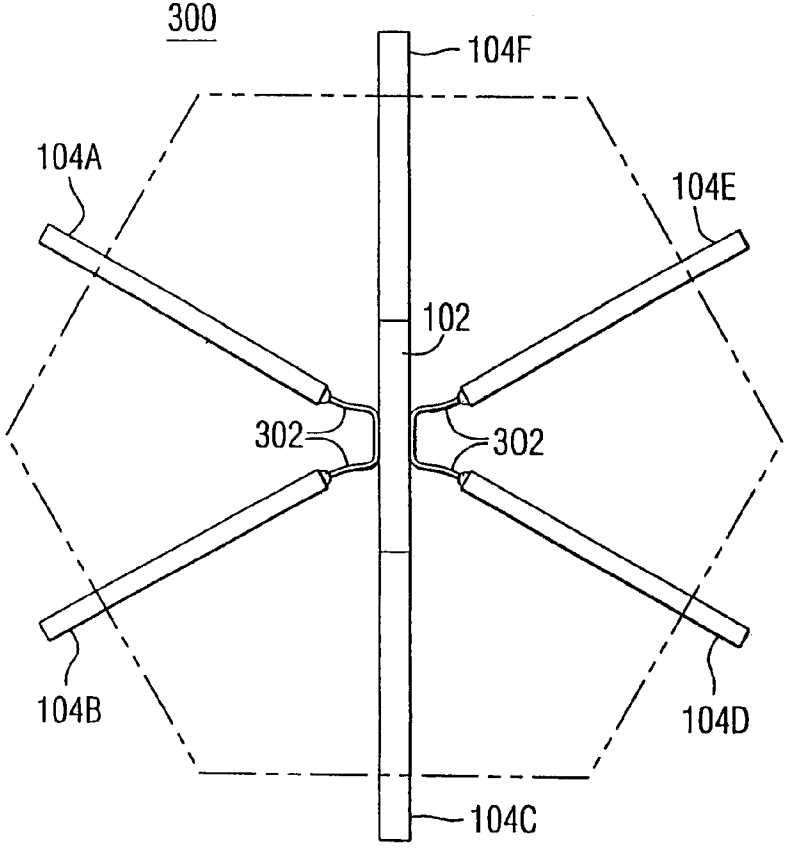

FIG. 8 illustrates another embodiment 300 of an antenna array according to the teachings of the present invention, wherein the passive elements and the center element in the FIG. 8 embodiment are similar to those illustrated in FIG. 2. Each of the passive elements 104A, 104B, 104D and 104E is disposed on a rigid substrate (e.g., FR4 material) and joined to the center element 102 via a deformable material, such as mylar, as indicated by a reference character 302. The passive elements 104F and 104C are disposed on the same substrate as the center element 102.

Figure 9B:
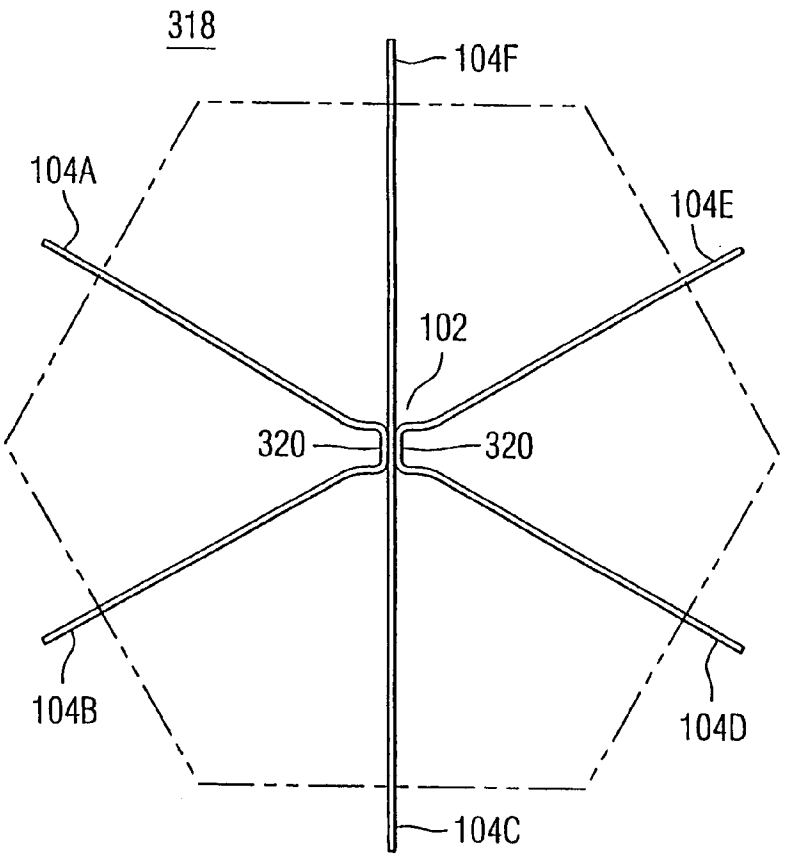
FIGS. 8, 9A, 9B, 10A, 10B, 11, 12A, 12B, 13, 14A, 14B, 15A, 15B, 16A, 16B, 17A and 17B illustrate additional embodiments of antennas.
Figure 9A:
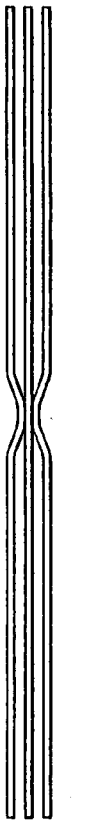

In yet another embodiment of the antenna array 318 illustrated in FIGS. 9A and 9B, the passive elements 104A and 104B are formed on a first deformable material, the passive elements 104D and 104E are formed on a second deformable material, and the center element 102 and the passive elements 104C and 104F are formed on a third deformable material. The three deformable materials are joined together using an adhesive or mating vias soldered together to create the deformable union 320. The antenna array 318 is illustrated in the deployed configuration in FIG. 9B and in the stowed configuration in FIG. 9A. In a derivative embodiment, the antenna array 318 does not include the center element 102, such that the six antenna elements surrounding the deformable union 320 operate as an antenna phased array.

In the various embodiments discussed herein, for optimum antenna performance each of the passive elements 104A through 104F must be oriented at a specified angel or range of angles with respect to each other and the center element 102 (in those embodiments where a center element is present). This can be accomplished by mounting the antenna array on a base surface (now shown) and placing marks or mechanical stops on the base surface to ensure that each of the passive elements 104A through 104F is deployed to the correct position. Alternatively, if the antenna is mounted within a case or enclosure, various mechanical structures or stops can be incorporated into the enclosure so that in the deployed orientation, each of the passive elements 104A through 104F is situated at the optimum position.

Figure 10B:
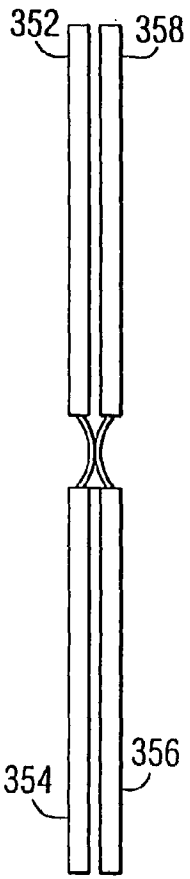
Figure 10A:
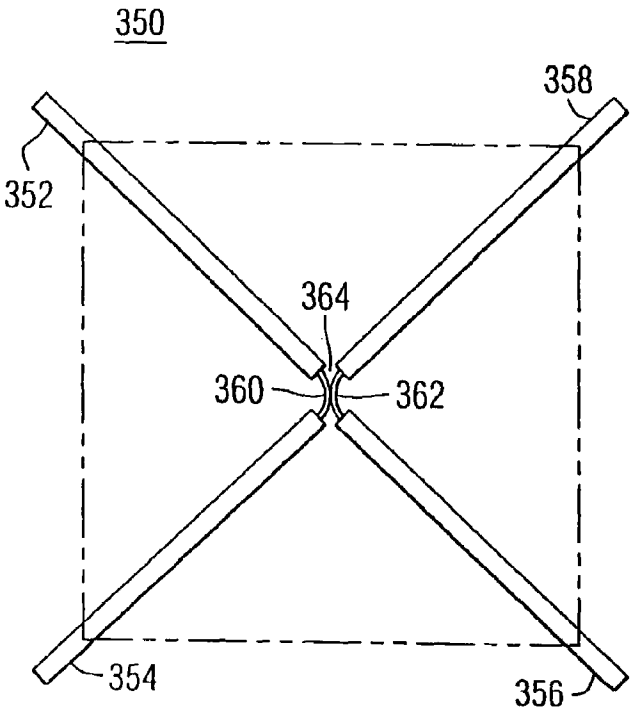

FIGS. 10A and 10B illustrate another embodiment of the present invention, that is an antenna array 350 including four elements 351, 354, 356 and 358 each formed on a rigid dielectric substrate. As can be seen, the antenna elements 352 and 254 are formed on individual deformable substrates and jointed by deformable material 360. Similarly, the antenna elements 356 and 358 are formed on individual sheets and jointed by material 362. The deformable materials 360 and 362 are jointed at a junction 364. As discussed above, vias can be utilized to create the junction 364 or the materials can be joined by an adhesive process. FIG. 10B illustrates the antenna array 350 in a stowed configuration.

Figure 11:
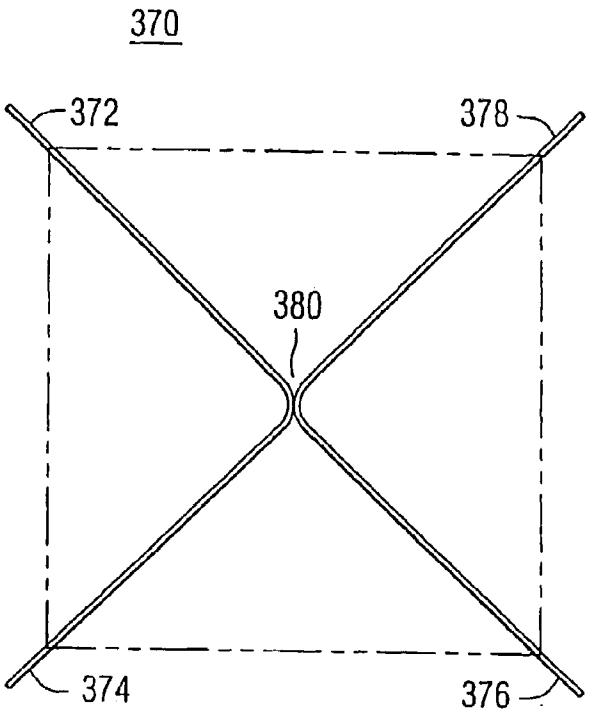

FIG. 11 illustrates the deployed state of an antenna array 370 comprising four elements 372, 374, 376 and 378 disposed on flexible or deformable material and joined at a junction 380. Conventionally, since the antenna arrays 350 (FIGS. 10A and 10B) and 370 (FIG. 11) lack a center element, they operate as phased array antennas for scanning the antenna beam as desired.

Figure 12B:
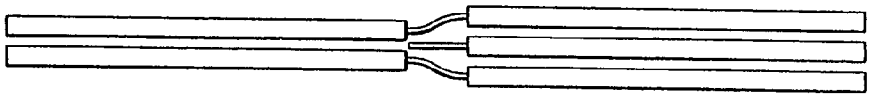
Figure 12A:
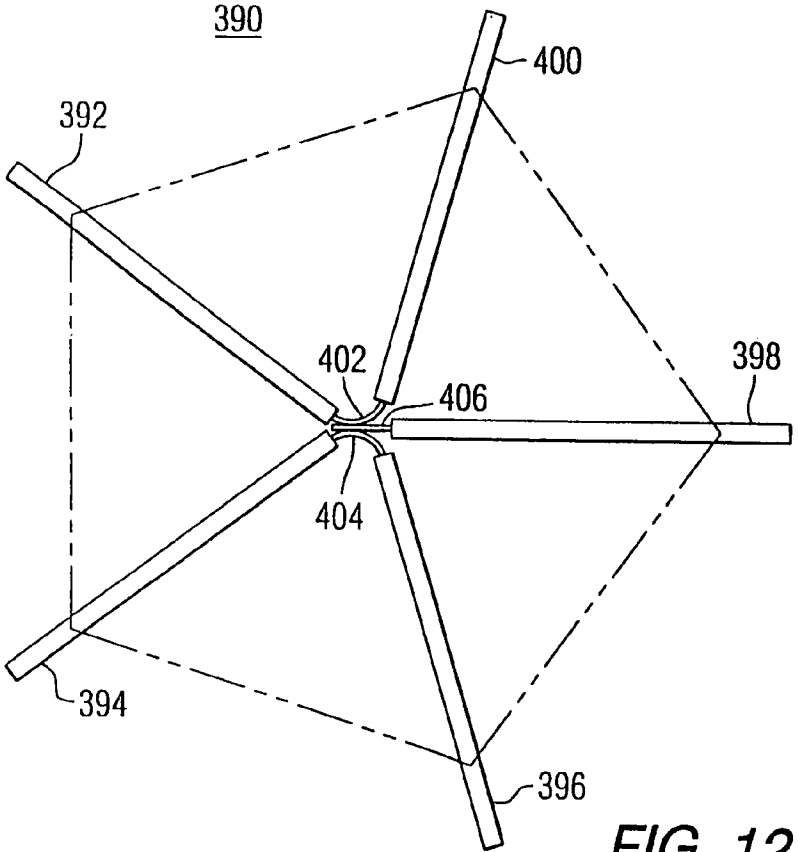

FIGS. 12A and 12B illustrate a five element antenna array 390 including elements 392, 394, 396, 398 and 400. In the FIG. 12A and 12B embodiment the elements 392 through 400 are disposed on a rigid dielectric substrate and joined at a deformable union. As can be seen, the antenna elements 392 and 400 are formed on individual dielectric substrates and joined to deformable material 402. The elements 394 and 396 are also formed separately and joined by deformable material 400. Finally, the element 398 includes a joining surface 406. The deformable materials 402 and 404 and the joining surface 406 are mated and attached either adhesively or through mating vias as discussed above. The antenna array 390 is shown in the folded or stowed configuration in FIG. 12B.

Figure 13:
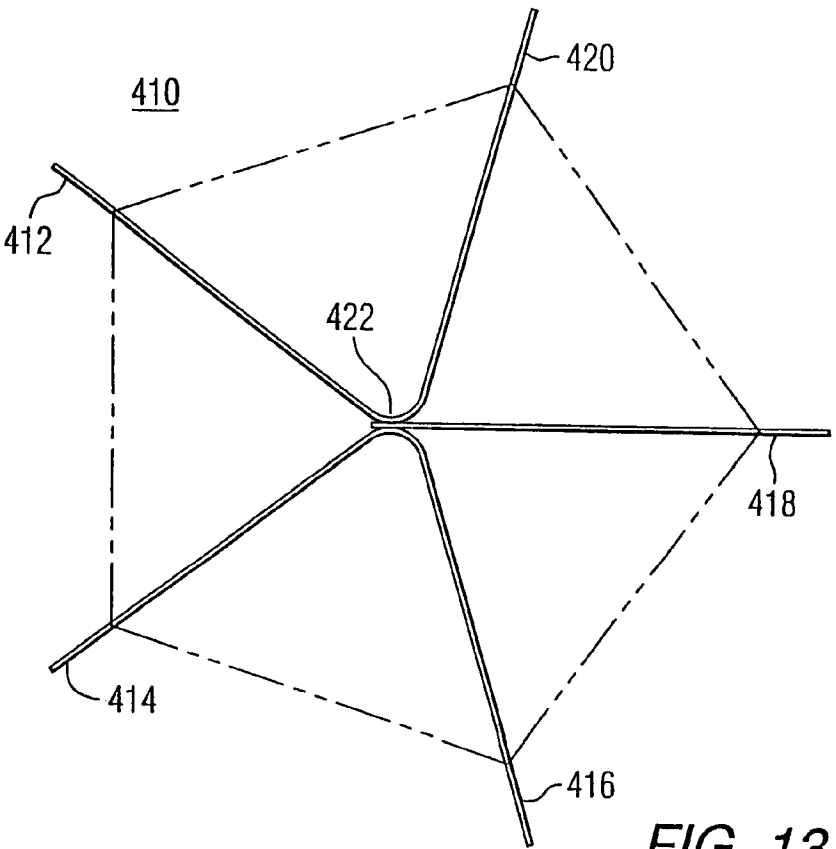

FIG. 13 illustrates an antenna array 410 having five elements 412, 414, 416, 418 and 420 disposed on flexible or deformable material. In particular, the antenna elements 412 and 420 are disposed on a single sheet of deformable material and the antenna elements 414 and 416 are likewise disposed on a sheet of single material. The antenna element 418 is disposed on a single sheet of deformable material. As can be seen, the elements 412 through 420 are then joined at a mating junction 422 created by adhesively connecting or soldering vias as discussed above. In another embodiment (not shown) a center element can be disposed on the same deformable material as the antenna element 418.

Figure 14B:
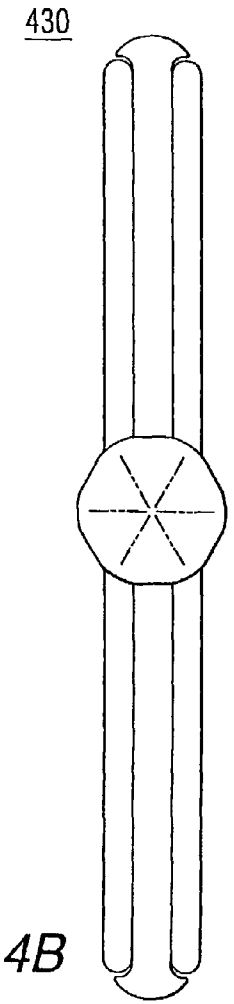
Figure 14A:
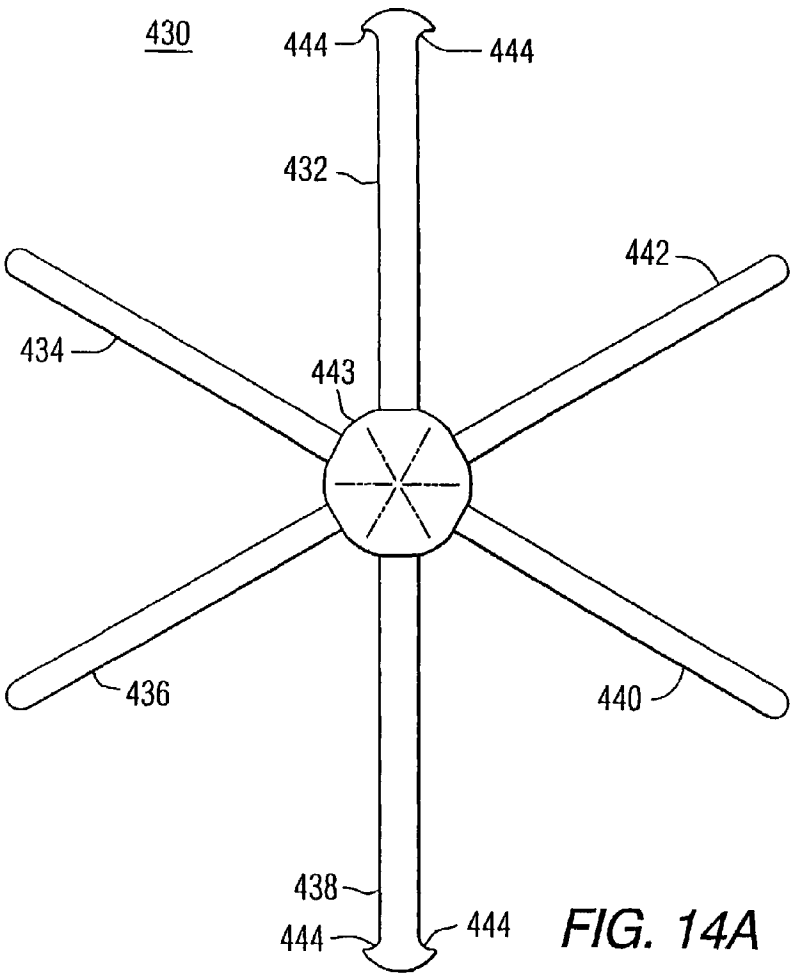

An antenna array 430 is illustrated in the deployed configuration in FIG. 14A and the folded or stowed configuration in FIG. 14B. The antenna array 430 includes antenna elements 432, 434, 436, 438, 440 and 442. The antenna elements are joined in a center hub 443 using the soldered vias or adhesive techniques described above. The antenna array 430 includes radii 444 on each side of the element 432 and the element 438. As shown in FIG. 14B, the use of the radii 444 provides a more compact stowed configuration as each of the remaining elements 434, 436, 440 and 442 fit within the radii 444.

Figure 15B:
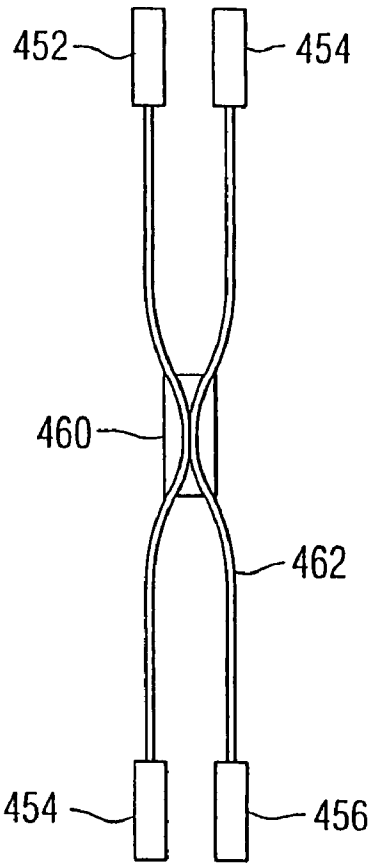
Figure 15A:
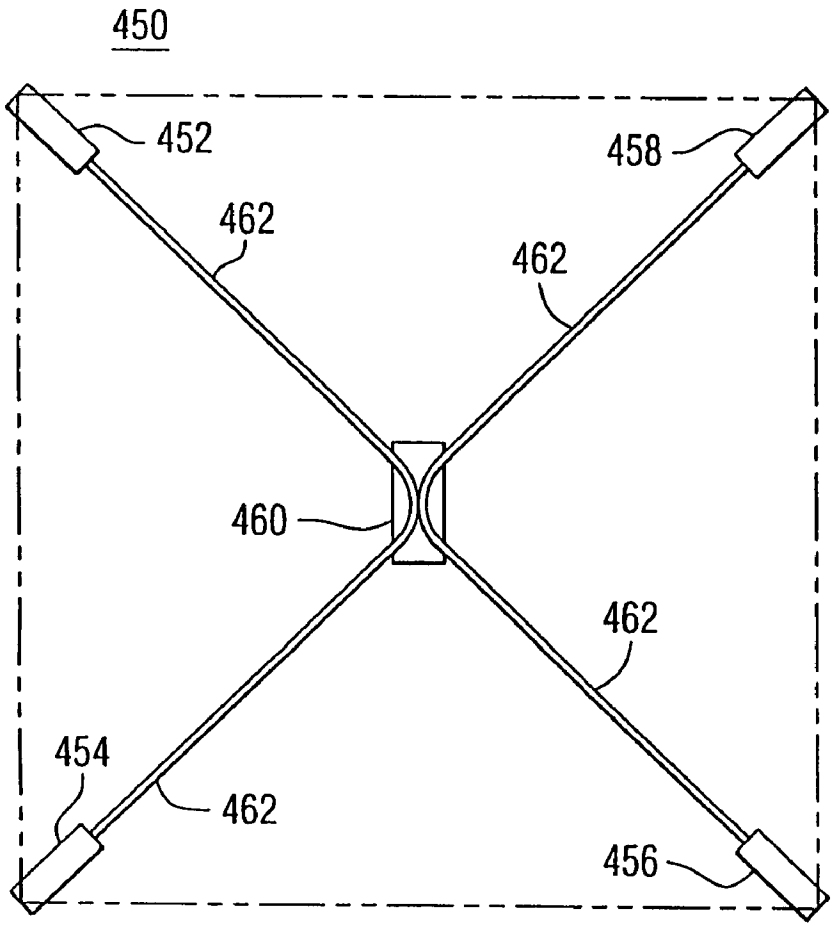

A five element antenna array 450, including a center element is shown in FIGS. 15A and 15B. Radial elements 452, 454, 456 and 458 are spaced apart from a center element 460. The elements 452, 454, 456 and 458 in one embodiment are disposed on a flexible or deformable material 462 (not shown in FIG. 15A), while in another embodiment, the elements 452, 454, 456 and 458 are disposed on a rigid dielectric substrate and attached to deformable material 462. The various sheets of deformable material 462 are joined at the center element 460 using the same techniques in the folded configuration in FIG. 15B.

Figure 16B:
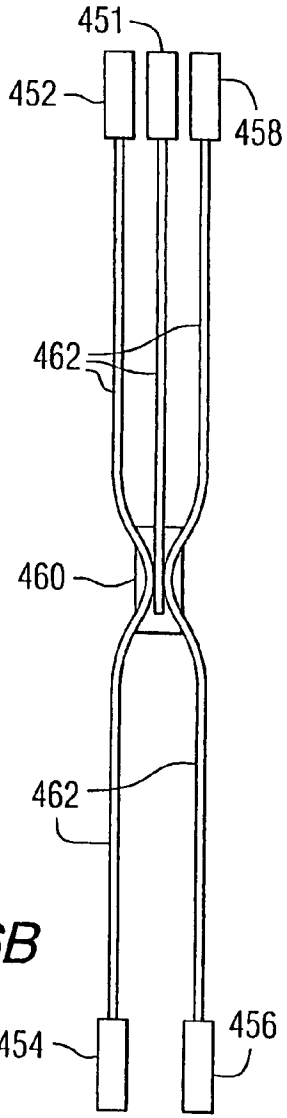
Figure 16A:
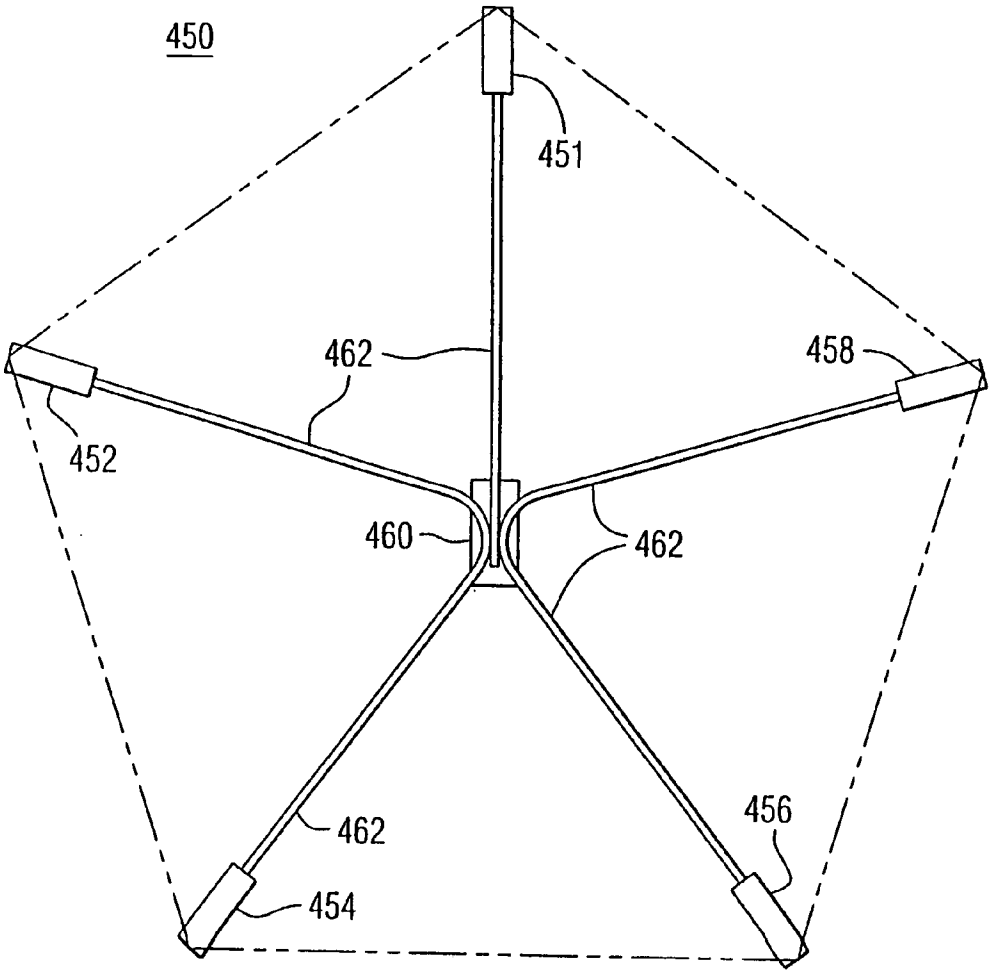

FIGS. 16A and 16B illustrate another embodiment of the antenna array 450, including an additional antenna element 451. Thus the antenna array 450 as illustrated in FIGS. 16A and 16B is a five element array. Due to the odd number of elements, one of the elements, specifically, the element 451 is disposed singly on a rigid dielectric material, which is in turn mated with the deformable material 462, and joined to the other two pairs of elements and to the center element 460 as shown in FIG. 16A. The techniques for attaching the elements 451, 452, 454, 456 and 458 at the center element 450 are discussed above. FIG. 16B illustrates the antenna array 450 wherein the five elements are shown in the folded or stowed configuration.

Figure 17B:
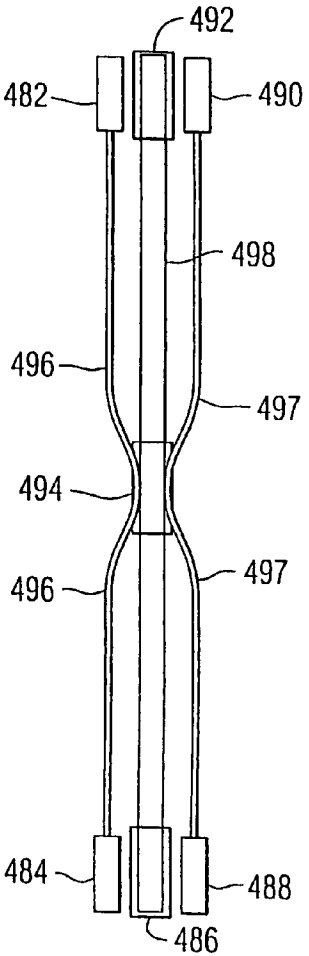
Figure 17A:
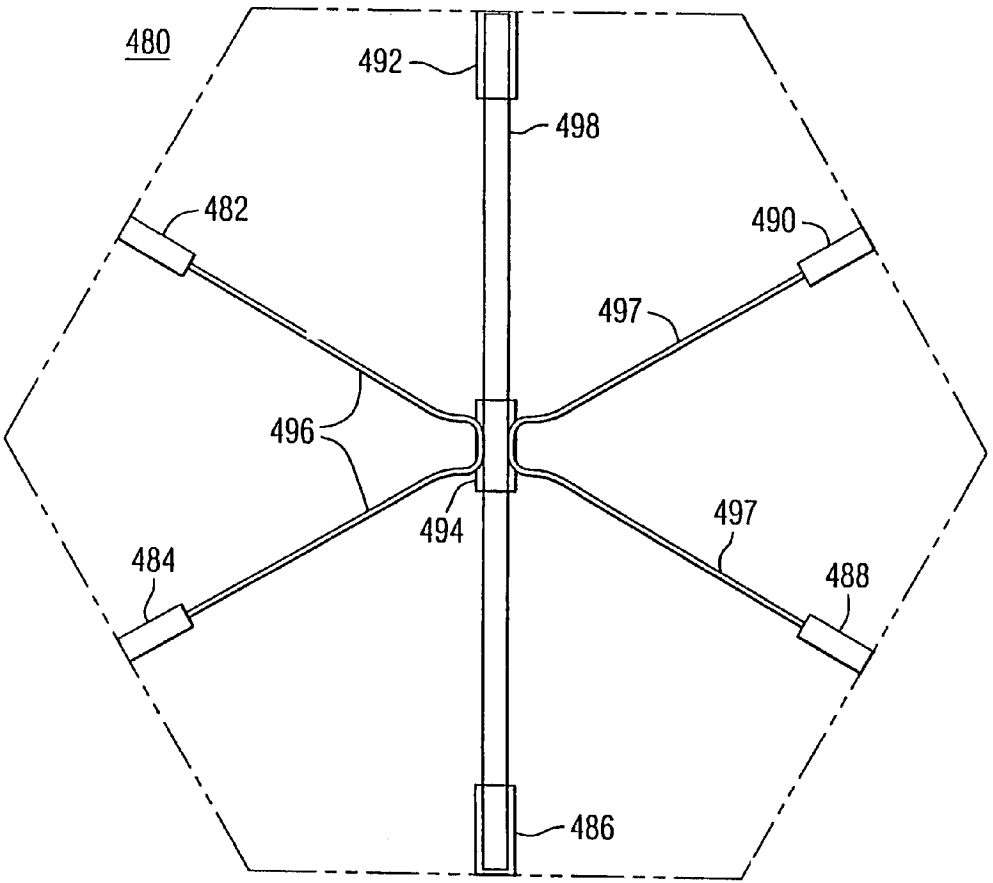

FIGS. 17A and 17B illustrate an antenna array having seven elements including radial elements 482, 484, 486, 488, 490 and 492 and a center element 494. In one embodiment as shown, the radial elements 482 and 494 are disposed on a rigid dielectric material and joined by way of a sheet of deformable material 496. The radial elements 488 and 490 are likewise constructed and joined by way of a sheet of deformable material 497. In both cases, the radial elements can be disposed on the rigid dielectric material by printing or etching. The radial elements 486 and 492 and the center element 494 are disposed on a rigid dielectric substrate 498. The deformable sheets 496 and 497 are attached to the center element 494 by way of vias, an adhesive or a mechanical fastener as discussed above. The antenna array 480 is shown in the folded or stowed configuration in FIG. 17B. In another embodiment (not shown) the radial elements 482, 484, 486, 488, 490 and 492 are disposed on flexible or deformable material and joined as shown.

The teachings of the present invention have been described in conjunction with various antenna arrays having an active center element and a plurality of radial elements spaced apart therefrom, or having only a plurality of spaced apart radial elements operation as conventional phased arrays or digital beam formers. In a first such embodiment, the antenna array comprises a plurality of active or passive elements, including a single active element at the center and a plurality of radially spaced apart active or passive elements deformably joined to the center active element. In another embodiment, each of the radial elements is joined to one or more other radial elements at the central intersecting point. Control signals and radio frequency signals are input to or received from the various antenna embodiments through an interface (similar to the interface 125 of FIG. 2) affixed to the intersecting point of the plurality of antenna elements. Various devices and techniques are known and available for attaching the antenna elements to the center element or to a center point if the center element is absent. Included among these devices and techniques are solderable vias, adhesives, and mechanical fasteners as discussed above.

While the invention has been described with references to a preferred embodiment, it will be understood by those skilled in the art that various changes may be made and equivalent elements may be substituted for the elements of the invention without departing from the scope thereof. The scope of the present invention further includes any combination of the elements from the various embodiments set forth herein. In addition, modifications may be made to adapt a particular situation to the teachings of the present invention without departing from the essential scope thereof. Therefore, it is intended that the invention not be limited to the particular embodiment disclosed as the best mode contemplated for carrying out this intention, but that the invention will include all other constructions falling within the scope of the appended claims.

What is claimed is:

1. An antenna comprising:

a dielectric substrate;

an active antenna element carried by said dielectric substrate;

at least one passive antenna element carried by said dielectric substrate and laterally adjacent said active antenna element;

at least one impedance element carried by said dielectric substrate and selectively connectable to said at least one passive antenna element for antenna beam steering; and at least one image element carried by said dielectric substrate, and connected to said at least one impedance element and ground.

2. An antenna according to claim 1 wherein each image element is associated with a respective impedance element and a respective passive antenna element.

3. An antenna according to claim 1 wherein each passive antenna element comprises a monopole antenna element.

4. An antenna according to claim 1 wherein each image element is approximately a same length as a corresponding passive antenna element.

5. An antenna according to claim 1 wherein each image element is approximately a same shape as a corresponding passive antenna element.

6. An antenna according to claim 1 wherein each impedance element is associated with a respective passive antenna element, each impedance element comprising an inductive load and a capacitive load, with said inductive load and said capacitive load being selectively connectable to the respective passive antenna element.

7. An antenna according to claim 1 further comprising:

at least one second dielectric substrate connected to said dielectric substrate adjacent said active antenna element;

at least one second passive antenna element carried by each second dielectric substrate, each second passive antenna element being laterally adjacent said active antenna element;

a second impedance element selectively connectable to each respective second passive antenna element for antenna beam steering; and at least second image element carried by each second dielectric substrate, with a second image element being connected to a respective second impedance element and ground.

8. An antenna according to claim 7 wherein each second passive antenna element comprises a monopole antenna element.

9. An antenna according to claim 7 wherein each second image element is approximately a same length as a corresponding second passive antenna element.

10. An antenna according to claim 7 wherein each second image element is approximately a same shape as a corresponding second passive antenna element.

11. An antenna according to claim 7 wherein each second impedance element is associated with a respective second passive antenna element, each second impedance element comprising an inductive load and a capacitive load, with said inductive load and said capacitive load being selectively connectable to the respective second passive antenna element.

12. An antenna according to claim 1 wherein said dielectric substrate comprises a flexible dielectric substrate.

13. A communications device comprising:

a transceiver; and an antenna for generating a plurality of antenna beams, said antenna connected to said transceiver and comprising a dielectric substrate, an active antenna element carried by said dielectric substrate, at least one passive antenna element carried by said dielectric substrate and laterally adjacent said active antenna element, at least one impedance element carried by said dielectric substrate and selectively connectable to said at least one passive antenna element for antenna beam steering, and at least one image element carried by said dielectric substrate, and connected to said at least one impedance element and ground.

14. A communications device according to claim 13 wherein each image element is associated with a respective impedance element and a respective passive antenna element.

15. A communications device according to claim 13 wherein each passive antenna element comprises a monopole antenna element.

16. A communications device according to claim 13 wherein each image element is approximately a same length as a corresponding passive antenna element.

17. A communications device according to claim 13 wherein each image element is approximately a same shape as a corresponding passive antenna element.

18. A communications device according to claim 13 wherein each impedance element is associated with a respective passive antenna element, each impedance element comprising an inductive load and a capacitive load, with said inductive load and said capacitive load being selectively connectable to the respective passive antenna element.

19. A communications device according to claim 13 further comprising:

at least one second dielectric substrate connected to said dielectric substrate adjacent said active antenna element;

at least one second passive antenna element carried by each second dielectric substrate, each second passive antenna element being laterally adjacent said active antenna element;

a second impedance element selectively connectable to each respective second passive antenna element for antenna beam steering; and at least second image element carried by each second dielectric substrate, with a second image element being connected to a respective second impedance element and ground.

20. A communications device according to claim 13 wherein said dielectric substrate comprises a flexible dielectric substrate.

21. A method for making an antenna comprising:

forming an active antenna element on a dielectric substrate;

forming at least one passive antenna element on the dielectric substrate that is laterally adjacent the active antenna element;

forming at least one impedance element that is selectively connectable to the at least one passive antenna element for antenna beam steering; and forming at least one image element on the dielectric substrate, and connecting the at least one image element to the at least one impedance element and ground.

22. A method according to claim 21 wherein each image element is associated with a respective impedance element and a respective passive antenna element.

23. A method according to claim 21 wherein each passive antenna element comprises a monopole antenna element.

24. A method according to claim 21 wherein each image element is approximately a same length as a corresponding passive antenna element.

25. A method according to claim 21 wherein each image element is approximately a same shape as a corresponding passive antenna element.

26. A method according to claim 21 wherein each impedance element is associated with a respective passive antenna element, each impedance element comprising an inductive load and a capacitive load, with the inductive load and the capacitive load being selectively connectable to the respective passive antenna element.

27. A method according to claim 21 further comprising:

connecting at least one second dielectric substrate to the dielectric substrate adjacent the active antenna element;

forming at least one second passive antenna element on each second dielectric substrate, each second passive antenna element being laterally adjacent the active antenna element;

forming a second impedance element to be selectively connectable to each respective second passive antenna element for antenna beam steering; and forming at least second image element on the second dielectric substrate, with a second image element being connected to a respective second impedance element and ground.

28. A method according to claim 27 wherein each second passive antenna element comprises a monopole antenna element.

29. A method according to claim 27 wherein each second image element is approximately a same length as a corresponding second passive antenna element.

30. A method according to claim 27 wherein each second image element is approximately a same shape as a corresponding second passive antenna element.

31. A method according to claim 27 wherein each second impedance element is associated with a respective second passive antenna element, each second impedance element comprising an inductive load and a capacitive load, with the inductive load and the capacitive load being selectively connectable to the respective second passive antenna element.

* * * * *

UNITED STATES PATENT AND TRADEMARK OFFICE

CERTIFICATE OF CORRECTION

PATENT NO. : 7,034,761 B2
APPLICATION NO. : 10/889662
DATED : April 25, 2006
INVENTOR(S) : Chiang et al.

It is certified that error appears in the above-identified patent and that said Letters Patent is hereby corrected as shown below:

| | |
|---|---|
| Title Page, Item (57) Line 1 | Delete: “ative”<br>Insert: --active-- |
| Column 1, Line 49 | Delete: “affects”<br>Insert: --effects-- |
| Column 2, Line 46 | Delete: “phase array”<br>Insert: --phased array-- |
| Column 2, Line 66 | Delete: “or manage”<br>Insert: --to manage-- |
| Column 3, Line 58 | Delete: “consequence”<br>Insert: --consequent-- |
| Column 3, Line 66 | Delete: “tune”<br>Insert: --tuned-- |
| Column 3, Line 66 | Delete: “received”<br>Insert: --receive-- |
| Column 4, Line 12 | Delete: “received”<br>Insert: --receiver-- |
| Column 4, Line 43 | Delete: “received”<br>Insert: --receiver-- |
| Column 5, Line 49 | Delete: “to in”<br>Insert: --in-- |
| Column 6, Line 63 | Delete: “date”<br>Insert: --data-- |
| Column 7, Line 1 | Delete: “cell-base”<br>Insert: --cell-based-- |
| Column 7, Line 2 | Delete: “employ and”<br>Insert: --employ an-- |

UNITED STATES PATENT AND TRADEMARK OFFICE

CERTIFICATE OF CORRECTION

PATENT NO. : 7,034,761 B2
APPLICATION NO. : 10/889662
DATED : April 25, 2006
INVENTOR(S) : Chiang et al.

It is certified that error appears in the above-identified patent and that said Letters Patent is hereby corrected as shown below:

| | |
|---|---|
| Column 7, Line 31 | Delete: "phase array"<br>Insert: --phased array-- |
| Column 9, Line 1 | Delete: "100 is a"<br>Insert: --100 in a-- |
| Column 9, Line 58 | Delete: "trace 125"<br>Insert: --traces 124-- |
| Column 9, Line 60 | Delete: "trace 125"<br>Insert: --trace 124-- |
| Column 10, Line 35 | Delete: "voltage ad"<br>Insert: --voltage as-- |
| Column 10, Line 67 | Delete: "angel"<br>Insert: --angle-- |
| Column 11, Line 4 | Delete: "now shown"<br>Insert: --not shown-- |
| Column 11, Line 14 | Delete: "351"<br>Insert: --352-- |
| Column 11, Line 16 | Delete: "254"<br>Insert: --354-- |
| Column 11, Line 37 | Delete: 'joined to"<br>Insert: --joined by-- |
| Column 12, Line 28 | Delete: "and 494"<br>Insert: --and 484-- |
| Column 12, Line 47 | Delete: "operation"<br>Insert: --operate-- |
| Column 12, Line 64 | Delete: "references"<br>Insert: --reference-- |

UNITED STATES PATENT AND TRADEMARK OFFICE

CERTIFICATE OF CORRECTION

PATENT NO. : 7,034,761 B2
APPLICATION NO. : 10/889662
DATED : April 25, 2006
INVENTOR(S) : Chiang et al.

It is certified that error appears in the above-identified patent and that said Letters Patent is hereby corrected as shown below:

| | |
|---|---|
| Column 13, Line 55 | Delete: "least second"<br>Insert: --least one second-- |
| Column 14, Line 61 | Delete: "least second"<br>Insert: --least one second-- |
| Column 16, Line 9 | Delete: "least second"<br>Insert: --least one second-- |

Signed and Sealed this

Twenty-eighth Day of November, 2006

JON W. DUDAS
*Director of the United States Patent and Trademark Office*